US008261817B2

(12) United States Patent
Hayter et al.

(10) Patent No.: US 8,261,817 B2
(45) Date of Patent: Sep. 11, 2012

(54) MODULAR HYDRAULIC OPERATOR FOR A SUBTERRANEAN TOOL

(75) Inventors: Steven Hayter, Houston, TX (US); William N. Triplett, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 326 days.

(21) Appl. No.: 12/618,123

(22) Filed: Nov. 13, 2009

(65) Prior Publication Data

US 2011/0114324 A1 May 19, 2011

(51) Int. Cl.
*E21B 34/10* (2006.01)

(52) U.S. Cl. ..... 166/102; 166/240; 166/331; 166/321

(58) Field of Classification Search ..... 166/331, 166/387, 102, 319, 321, 240
See application file for complete search history.

(56) References Cited

U.S. PATENT DOCUMENTS

| | | | | |
|---|---|---|---|---|
| 4,697,638 | A | 10/1987 | Knight | |
| 5,358,035 | A * | 10/1994 | Grudzinski | 166/53 |
| 5,549,161 | A | 8/1996 | Gomez | |
| 5,810,087 | A | 9/1998 | Patel | |
| 5,950,733 | A | 9/1999 | Patel | |
| 5,960,883 | A | 10/1999 | Tubel et al. | |
| 6,230,807 | B1 | 5/2001 | Patel | |
| 6,352,119 | B1 | 3/2002 | Patel | |
| 6,536,529 | B1 | 3/2003 | Kerr et al. | |
| 6,662,877 | B2 | 12/2003 | Patel | |
| 7,210,534 | B2 | 5/2007 | Hayter | |
| 7,237,616 | B2 | 7/2007 | Patel | |
| 7,503,390 | B2 | 3/2009 | Gomez | |
| 7,556,102 | B2 | 7/2009 | Gomez | |
| 7,594,542 | B2 | 9/2009 | Lorentz et al. | |
| 7,607,478 | B2 | 10/2009 | Martinez et al. | |
| 7,717,183 | B2 | 5/2010 | Ezell et al. | |
| 8,006,758 | B2 | 8/2011 | Reynolds et al. | |
| 8,009,059 | B2 | 8/2011 | Huang et al. | |
| 8,056,628 | B2 | 11/2011 | Whitsitt et al. | |
| 2007/0187107 | A1 * | 8/2007 | Pringle | 166/319 |
| 2010/0006279 | A1 | 1/2010 | Martinez et al. | |
| 2010/0139909 | A1 | 6/2010 | Tirado et al. | |

(Continued)

FOREIGN PATENT DOCUMENTS

WO 2010085667 A2 7/2010

(Continued)

OTHER PUBLICATIONS

Jabs, Matthew, et al., "New Expandable Cladding Technique Enables Extended Length Casing Repair", IADC/SPE 87212, Mar. 2004, 1-4.

(Continued)

*Primary Examiner* — William P Neuder
*Assistant Examiner* — Richard Alker
(74) *Attorney, Agent, or Firm* — Steve Rosenblatt

(57) ABSTRACT

A modular pressure operated actuator can be coupled with a downhole tool to selectively operate it at least once. In the preferred embodiment the module can be mounted adjacent an isolation valve and after a fixed number of on and off pressure cycles allow a spring to push an actuator to operate the valve to an open position. The actuator, in another embodiment, can be reset with a tool run into the module to move the actuator back against a power spring and hold that spring force until the pressure cycling begins again. The preferred application is for a formation isolation ball valve but other valves, such as sliding sleeves, or other types of downhole tools can be actuated with the module that permits a retrofit of a hydraulic operation to a heretofore purely mechanically actuated tool.

21 Claims, 13 Drawing Sheets

U.S. PATENT DOCUMENTS

| | | | |
|---|---|---|---|
| 2011/0000660 | A1 | 1/2011 | Joseph et al. |
| 2011/0114324 | A1 | 5/2011 | Hayter et al. |
| 2011/0168403 | A1 | 7/2011 | Patel |

FOREIGN PATENT DOCUMENTS

| | | | |
|---|---|---|---|
| WO | 2011002676 | A2 | 1/2011 |
| WO | 2011079173 | A2 | 6/2011 |

OTHER PUBLICATIONS

King, James, "Cost and Risk Reduction Through Innovation: Remotely Actuated Completion Equipment for Deepwater and Extended Reach Wells", SPE 68763, Apr. 2001, 1-11.

Myal, F.R., et al., "Slant-Hole Completion Test in the Piceance Basin, Colorado" SPE 21866, Apr. 1991, 611-622.

* cited by examiner

MODULAR HYDRAULIC OPERATOR FOR A SUBTERRANEAN TOOL

FIELD OF THE INVENTION

The field of the invention is a modular hydraulic assembly that can be coupled to an otherwise mechanically operated tool and preferably a valve to allow the option of hydraulically opening the tool or valve once or multiple times.

BACKGROUND OF THE INVENTION

Different valve styles have been used downhole. One type is a sliding sleeve valve that can selectively cover or open holes in a casing or liner string. These valves are typically shifted with a shifting tool that grabs a recess in the sleeve and pulls or pushes the sleeve to open or close the wall ports in the tubular. Some examples are U.S. Pat. No. 5,549,161; U.S. Pat. No. 7,556,102 and U.S. Pat. No. 7,503,390.

Formation isolation valves have been used that have a ball that is attached to a sleeve so that movement of the sleeve results in ball rotation between open and closed position. These valves typically included a piston responsive to tubing pressure that worked in conjunction with a j-slot mechanism. The valve was closed mechanically but could be opened once with a predetermined number of pressure cycles on the piston. Eventually, a long slot in the j-slot would be reached to allow a spring or a compressed gas reservoir to move an operating sleeve into another sleeve that was attached to the ball so that the ball could be rotated to the open position. In one design the ball was locked after moving into the open position but that lock could be overcome with another tool run downhole. There was also a provision for an emergency opening with a pressure tool if for some reason the pressure cycles failed to open the ball. This design is illustrated in U.S. Pat. No. 7,210,534. Other formation isolation valves that came as an assembly of a mechanically operated ball that had the option of opening with pressure cycles until a j-slot allowed a pressurized chamber charged to a known specific pressure to move an operating sleeve against another sleeve to get the ball to turn open are illustrated in U.S. Pat. No. 5,810,087 and U.S. Pat. No. 6,230,807 while U.S. Pat. No. 5,950,733 initiates opening the ball with pressure that breaks a rupture disc to liberate pressure previously stored to move a sleeve to open that valve.

These combination valves with the hydraulic open feature bundled into a mechanical valve such as a ball valve are very expensive and in many applications represent overkill because a manually operated barrier valve such as with a shifting tool run in on coiled tubing, for example would be sufficient and within the budget for the particular project. On the other hand, the specification for some projects changes where the previously ordered manual barrier valve is determined to be insufficient for the application without a hydraulic opening feature. A hydraulically operated module of the present invention addresses this need for flexibility and further makes it possible for use of the module on a variety of tools when those tools can respond to shifting of an operating rod. The hydraulic module further incorporates either a one-time only configuration which is the simpler variation or another variation that can be re-cocked after an actuation with a tool run in from the surface to move the operating piston back up. The unique configuration of the cycling control assembly allows the ability to re-cock with minimal displacement of the operating rod so that the tool can be shorter because the operating rod does not need to be displaced after the valve opens any further than it takes to land a snap ring back in a groove so that the series of pressure cycles can resume when another hydraulic opening of the valve is required. These and other advantages of the present invention will become more apparent to those skilled in the art from a review of the description of the preferred embodiment and the associated drawings while recognizing that the full scope of the invention is given by the appended claims.

SUMMARY OF THE INVENTION

A modular pressure operated actuator can be coupled with a downhole tool to selectively operate it at least once. In the preferred embodiment the module can be mounted adjacent an isolation valve and after a fixed number of on and off pressure cycles allow a spring to push an actuator to operate the valve to an open position. The actuator, in another embodiment, can be reset with a tool run into the module to move the actuator back against a power spring and hold that spring force until the pressure cycling begins again. The preferred application is for a formation isolation ball valve but other valves, such as sliding sleeves, or other types of downhole tools can be actuated with the module that permits a retrofit of a hydraulic operation to a heretofore purely mechanically actuated tool.

DETAILED DESCRIPTION OF THE PREFERRED EMBODIMENT

Figure 1A:
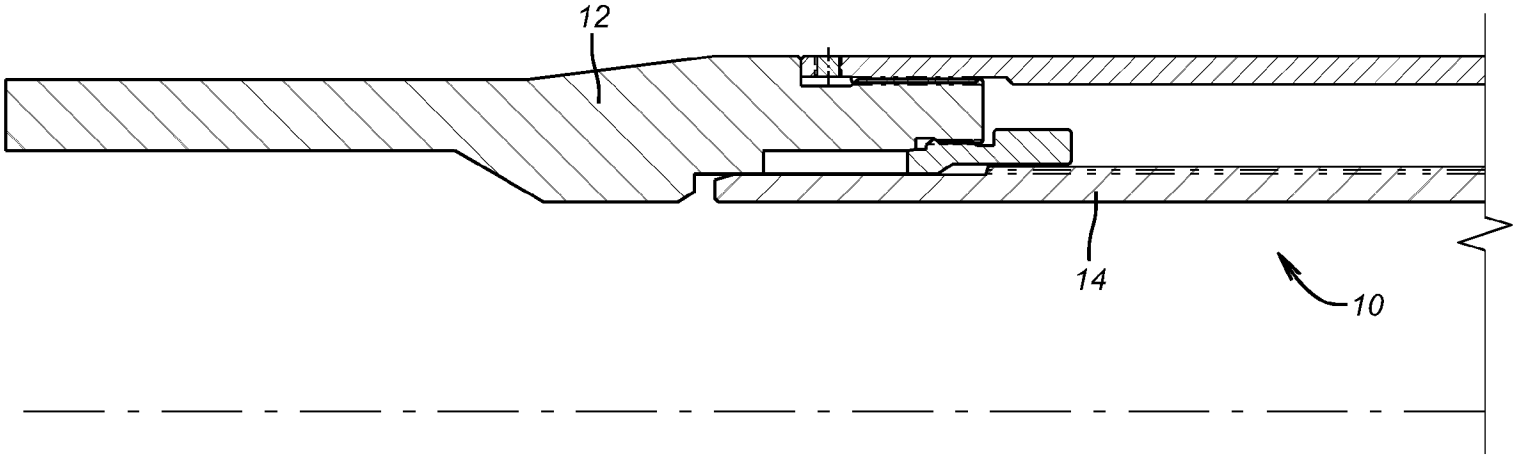
FIGS. 1*a*-1*d* are a section view of the hydraulic module that is capable of a single operation downhole.
Figure 1B:
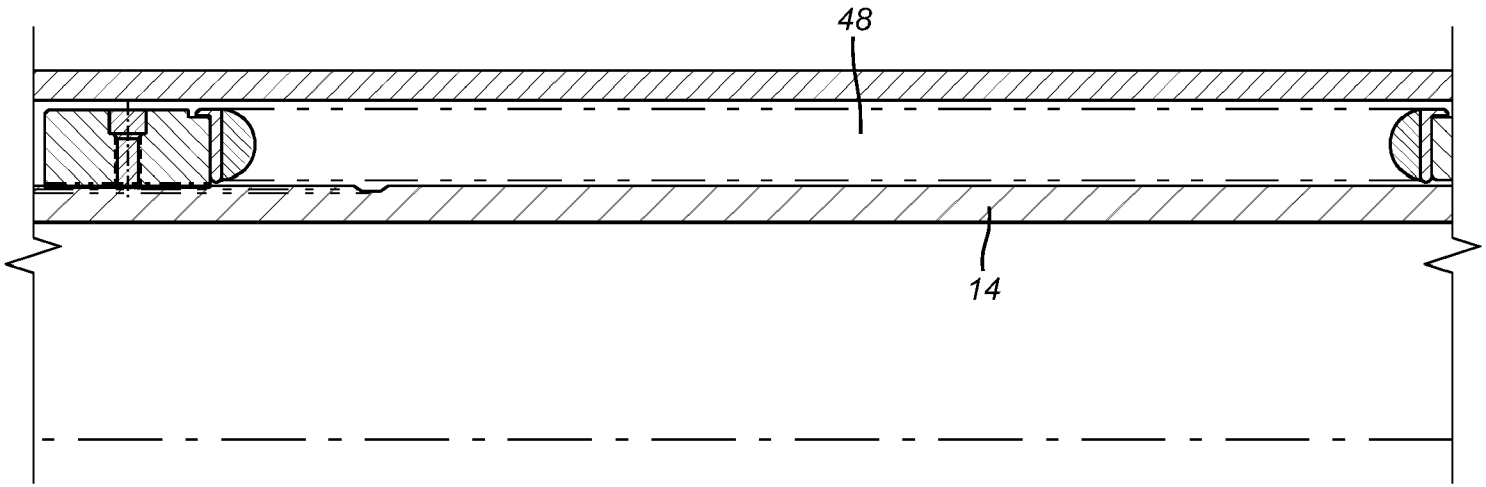
Figure 1C:
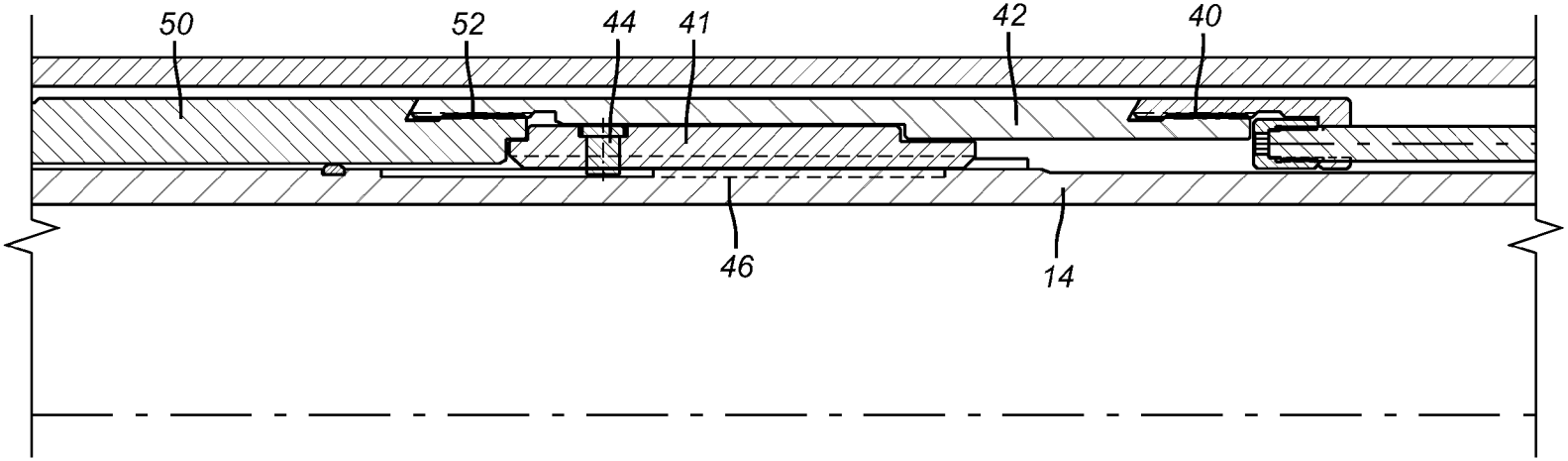

Referring to FIGS. 1*a*-1*d* the module 10 has a top sub 12 connected to a mandrel 14 followed by a bottom sub 16. Threads 18 secure the bottom sub 16 to a body 20 of the tool to be operated such as a valve. The tool 20 has an operating member 22, which when pushed by the pushrod 24 actuates the tool 20. In one embodiment member 22 turns a ball to open a formation isolation valve (not shown). Member 22 has a shoulder 26 for mechanical operation independent of the module 10 in opposed directions such as with a shifting tool that is run in to make contact with shoulder 26 or another shoulder (not shown) for selective movement to open or close the valve.

Push rod 24 is at an end of piston 25 and piston 25 has seal 28 to seal against bore 30. The lower end 32 is exposed to tubing pressure inside the module 10. Above seal 28 the bore 30 is referenced to annulus pressure at 36 through passage 34 and a filter 38 to keep dirt out of passage 34. This reference can be direct as shown or indirect using an intermediate floating piston (not shown) with a hydraulic fluid buffer so that bore 30 above seal 28 is exposed directly only to clean hydraulic fluid while from a pressure perspective the reference is still to annulus pressure at 36. Piston 25 is secured with cap 40 to indexing housing 42. Indexing sleeve 41 is free to rotate inside indexing housing 42 and has an inwardly oriented pin 44 that extends into a j-slot pattern 46, such as one shown in FIG. 3, which is a part of the mandrel 14. A spring 48 pushes off mandrel 14 and down against sub 50 that is secured at 52 to the indexing housing 42. With each application of pressure to end 32 the indexing sleeve 41 goes up and down while rotating as pin 44 advances in the j-slot 46 until pin 44 comes into a long slot in the j-slot pattern 46 at which time the spring 48 pushes the piston 25 and the rod 24 against the member 22 to operate the tool that is attached to it. Movement of the indexing sleeve 41 moves fluid into or out of the annulus 36 through passage 54 that communicates with passage 34. When the hydraulic module is not attached to the downhole tool, travel down stops when cap 40 hits bottom sub 16, or on intermediate cycles, travel down stops when indexing sleeve 42 hits lug 43 on mandrel 14. When the hydraulic module is attached to the downhole tool, on the final cycle, travel down stops when the valve operator shoulders in the downhole tool. This version of module 10 cannot be reset as it is a onetime operation to allow a purely mechanically operated valve to be cheaply converted to a hydraulic operation by the simple addition of a module 10 before running the assembled components downhole. The j-slot can be configured for a variety of pressure application and removal cycles before actuation. The pin 44 can be a pair of pins disposed at 180 degrees so that when there is actuation the movement is guided at the pins 44 to prevent cocking of the index sleeve 41. It should be noted that FIG. 3 has two long slots 6 cycles apart but that when two pins 44 are used it will take 12 cycles for both those pins to be aligned with the long slots and no other lugs blocking actuation for the actuation to happen. Depending on the number of cycles to actuation and the diameter of the components the use of blocking lugs can be eliminated and any alignment of the pins 44 with the illustrated long slots of the j-slot pattern of FIG. 3 will result in actuation of the piston 25 and the rod 24 to operate the preferred tool and that is a 90 degree isolation ball valve. Other tools such as sliding sleeve or packers with setting sleeves, for example can be optionally set hydraulically with the module 10.

The advantage of the module 10 is that it allows more versatility in the use of tools that are adequate in some applications with only mechanical operation. However, other applications where there is a need for a hydraulic operation at least one time as an option, allows the operator to upgrade with the additional purchase and installation of the module 10. It saves the operators with no use for the hydraulic option the expense of buying it because it has in the past been offered integrally with an otherwise mechanically operated tool.

FIGS. 2*a*-2*d* are a more fully featured version of the module of FIGS. 1*a*-1*d* and allows for a manual mechanical reset with a tool while the module is downhole so that multiple actuations are possible generally when used in a valve application, to repeatedly open a valve with pressure cycles after it has been closed mechanically. There are many similarities to the FIG. 1 embodiment but the basic parts and movements will be reviewed again with different item numbers to avoid confusion between the embodiments.

The module 60 has a top sub 62 connected to a mandrel 64, which is connected to a bottom sub 66. One or more rods 68 extend from respective bores 70 in bottom sub 66. Rod 68 is connected to a respective piston 72 that has a seal 74 in bore 70. Seal 74 defines a high pressure side at lower end 76 which is exposed to tubing pressure at 78. On the other side of seal 74 there is a passage system 80 that leads to annulus 82 through a filter 84 to keep out debris. A part of passage system 80 goes into annular space 86 defined by outer housing 88, which is connected at thread 90 to top sub 62.

Figure 2A:
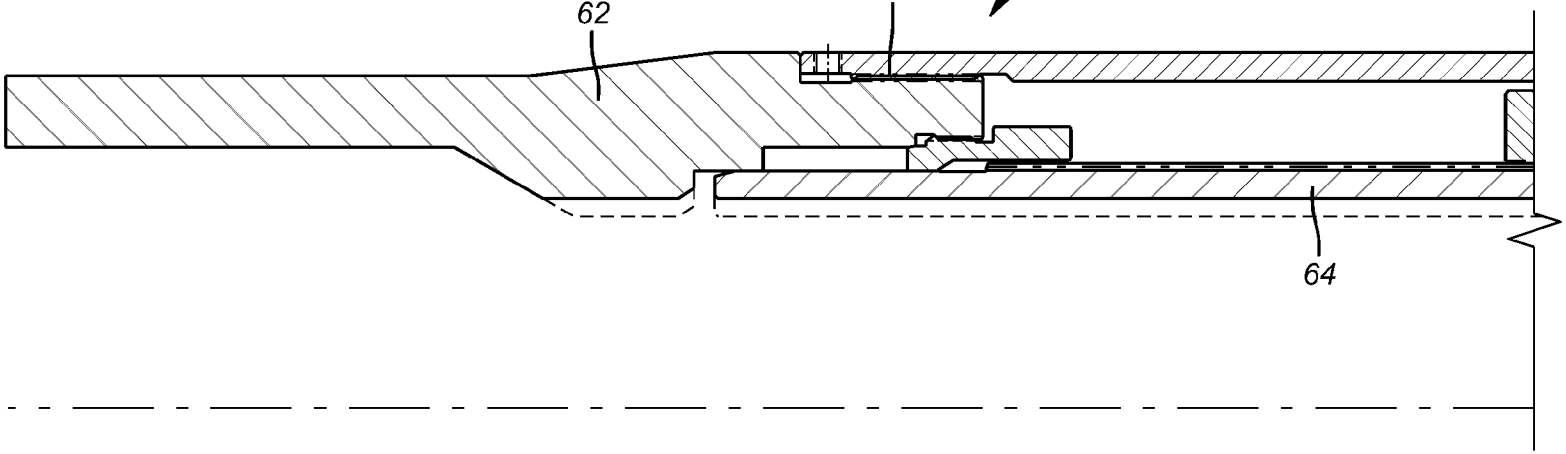
FIGS. 2*a*-2*d* are a section view of a resettable alternative embodiment shown in the position when pressure is bled off in the last cycle before the module is operated to actuate the downhole tool.
Figure 2B:
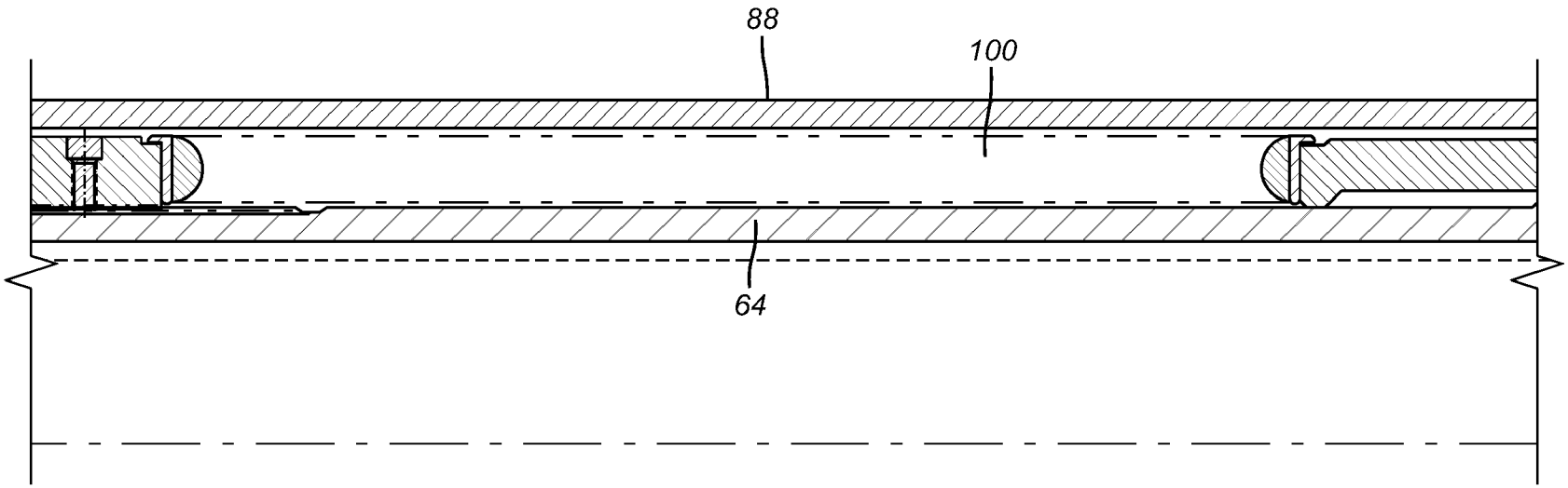
Figure 2C:
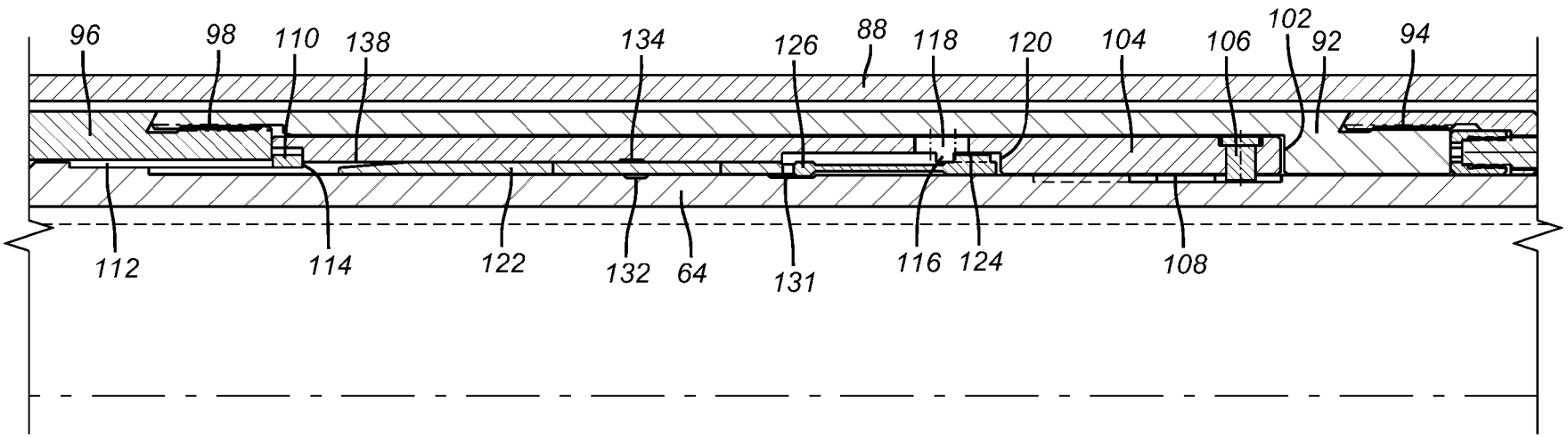
Figure 1D:
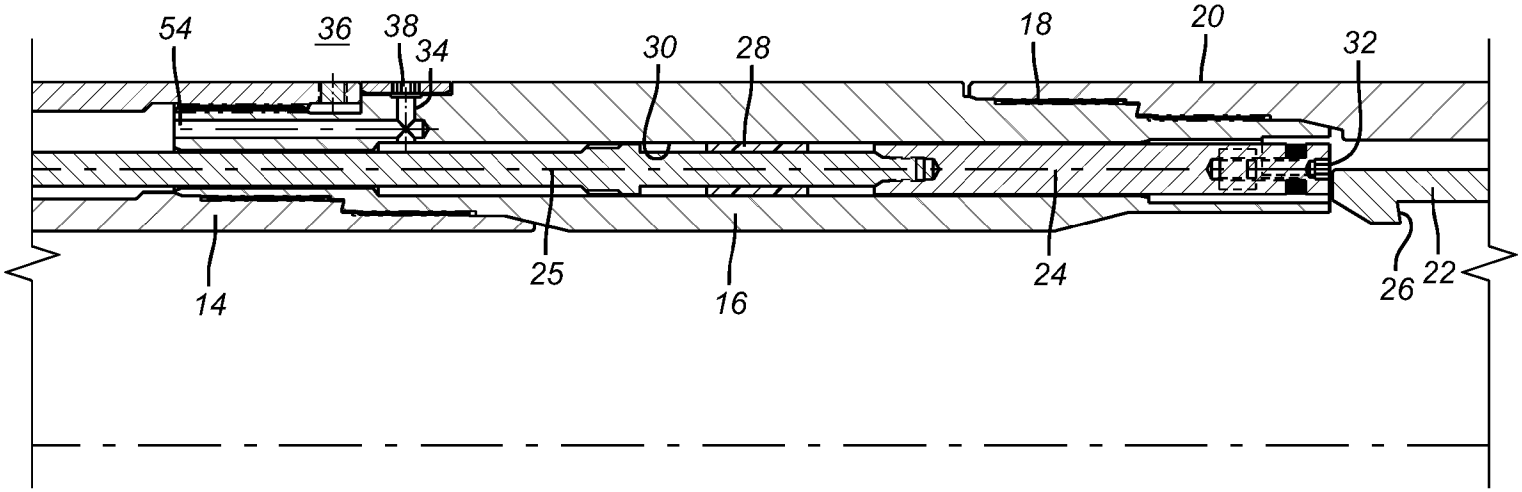
Figure 4:
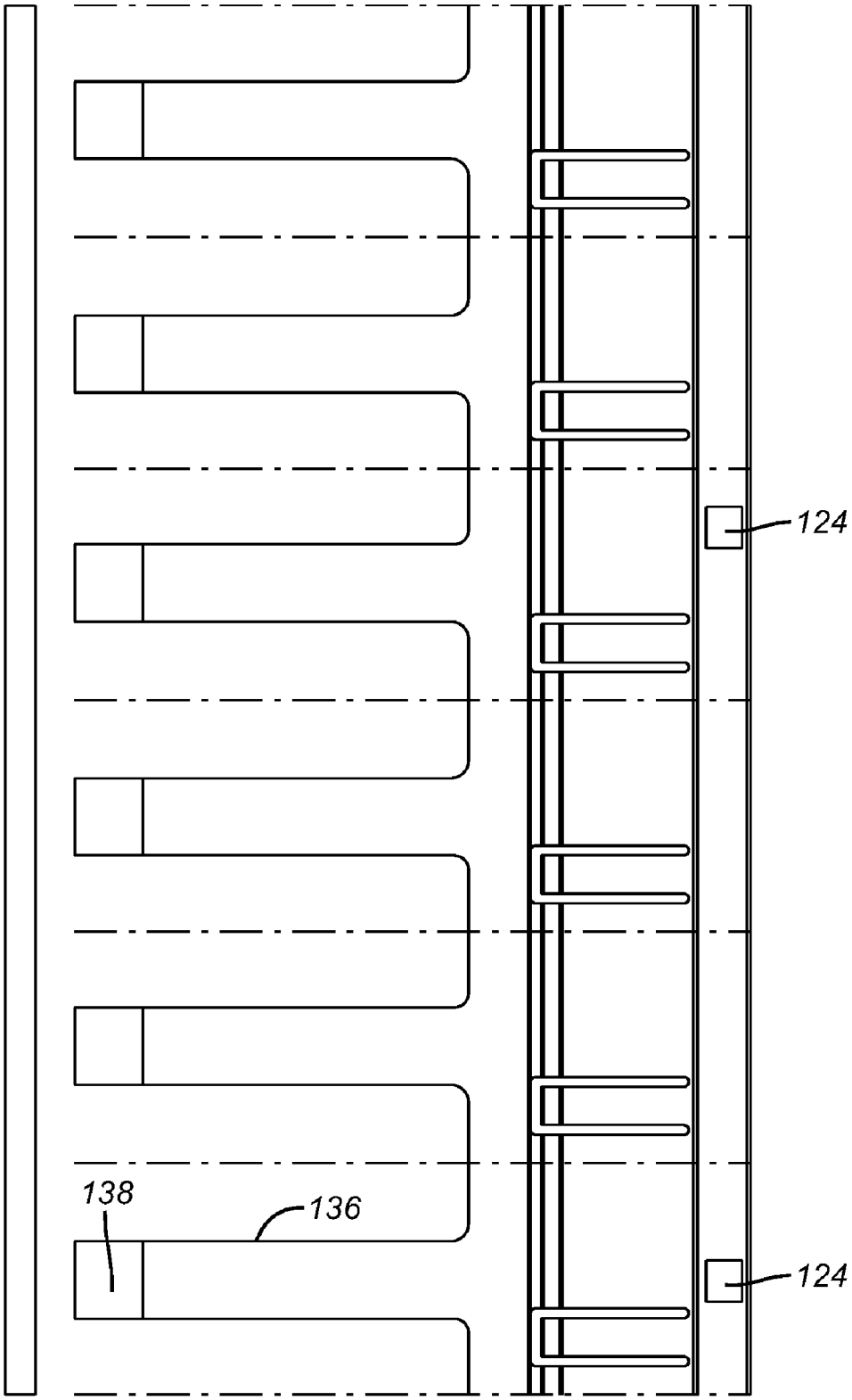
FIG. 4 is a rolled flat view of the exterior of the ramp sleeve that faces the indexing sleeve and the snap ring.
Figure 5:
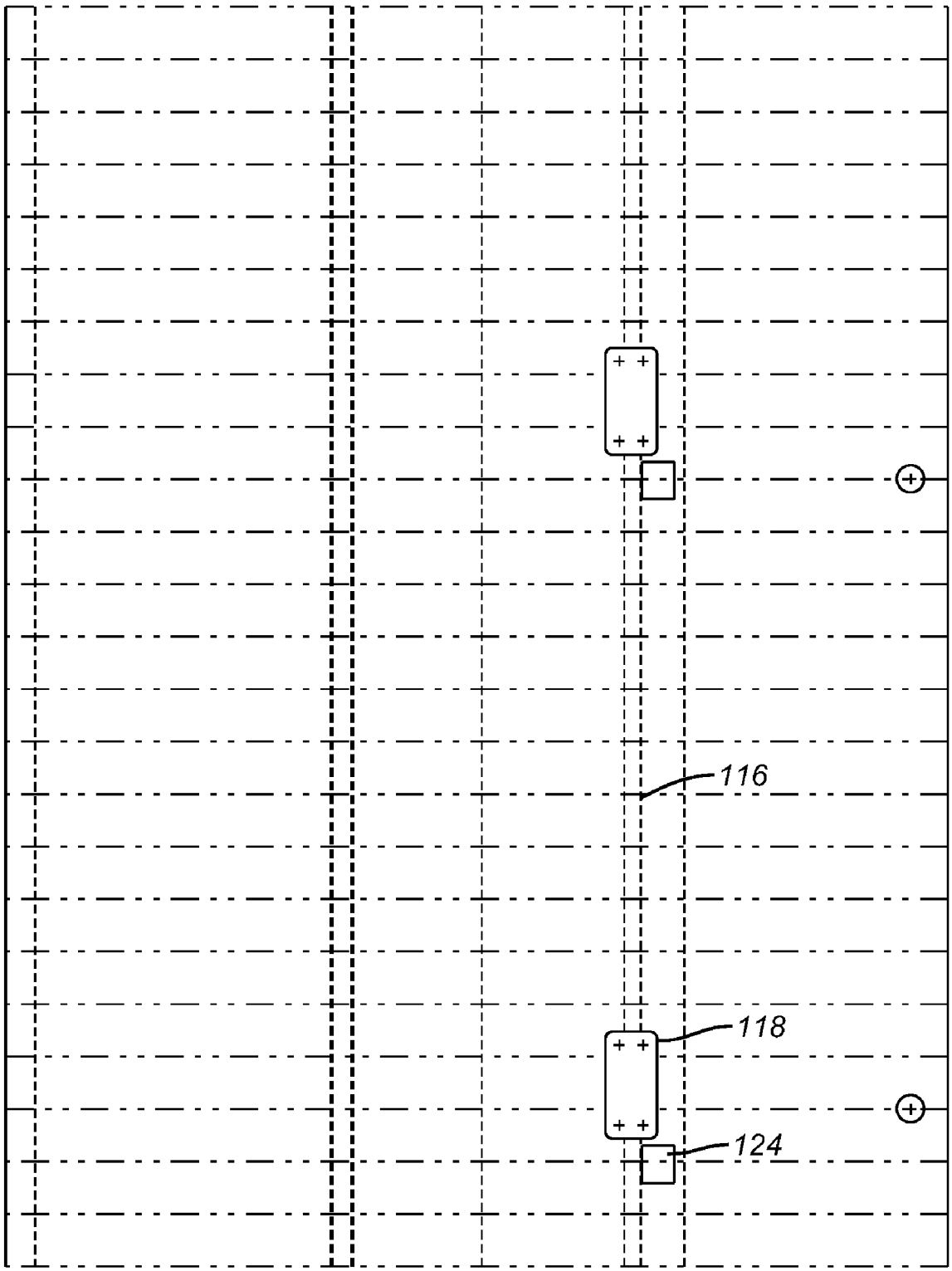
FIG. 5 is a rolled flat overlay of the indexing sleeve and the ramp sleeve showing indexing sleeve openings that permit relative movement between them just before actuation of the downhole tool.

Piston 72 is connected to indexing housing 92 at thread 94. Indexing housing 92 is also connected at the opposite end to spring sleeve 96 at thread 98. Spring 100 is disposed between sleeve 96 and mandrel 64. Pressure in the tubing 78 displaces the piston 72 and with it indexing housing 92 and spring sleeve 96 so that the spring 100 is compressed. This movement is longitudinal in opposed directions with no rotation. The index housing has a shoulder 102 on which is supported the index sleeve 104 along with one or more radially inwardly oriented index pins 106 that extend into a j-slot pattern 108 on mandrel 64. Index sleeve 104 rotates as pin or pins 106 track the stationary j-slot pattern 108 on mandrel 64. A snap ring 110 is securely disposed between indexing sleeve 104 and spring sleeve 96 while extending into longitudinal slot 112 that has a lower end 114. When the pressure in the tubing 78 is removed and the spring 100 is able to push down the indexing sleeve 104 that movement is stopped when snap ring 110 hits the lower end 114 of slot 112. As best seen in FIGS. 2*c* and 5 the indexing sleeve 104 has a discontinuous ridge 116 with breaks 118. Ridge 116 and shoulder 120 define a groove that for a predetermined number of application and removal of pressure cycles allows the indexing sleeve 104 to take with it the ramp sleeve 122 by keeping trapped lug or lugs 124 at the lower end of the ramp sleeve 122. The rolled out ramp sleeve 122 with lugs 124 is shown in FIG. 4. Ramp sleeve 122 has integral to it at its lower end, a series of collet fingers 126 that terminate in heads 130 that with pressure to the tubing 78 bled off will rest as shown in groove 131 of mandrel 64. Mandrel 64 also has an upper groove 132. Indexing sleeve 104 has a groove 134 facing the ramp sleeve 122. The purpose of these grooves will be explained when the part movement is further explained in the context of the actuation. Ramp sleeve 122 has a series of spaced apart fingers 136 best seen in FIG. 4 with tapered ends 138. Fingers 136 ride on the mandrel 64 in slots lower than groove 112. The purpose of the tapered ends 138 is to cam the snap ring 110 out of groove 112 so that at the proper time the lower end 114 of groove 112 will not act as a travel stop when pressure is taken off the tubing 78 and the spring 100 is pushing down the indexing sleeve 104 when its pin 106 is in the long slot 140 of j-slot 108.

Figure 2D:
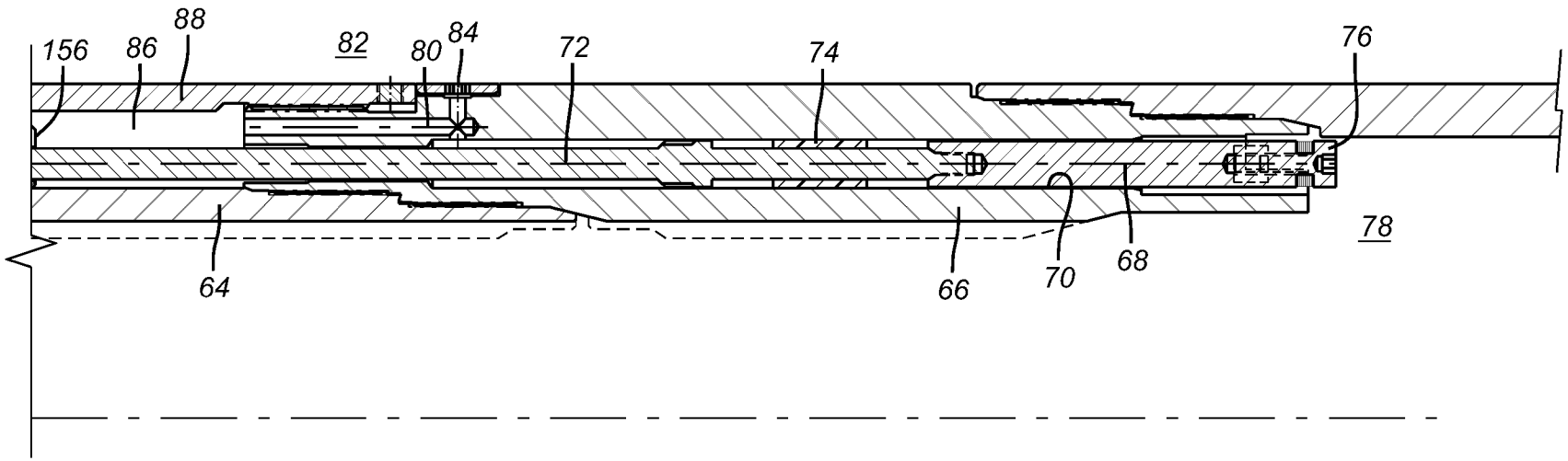
Figure 6A:
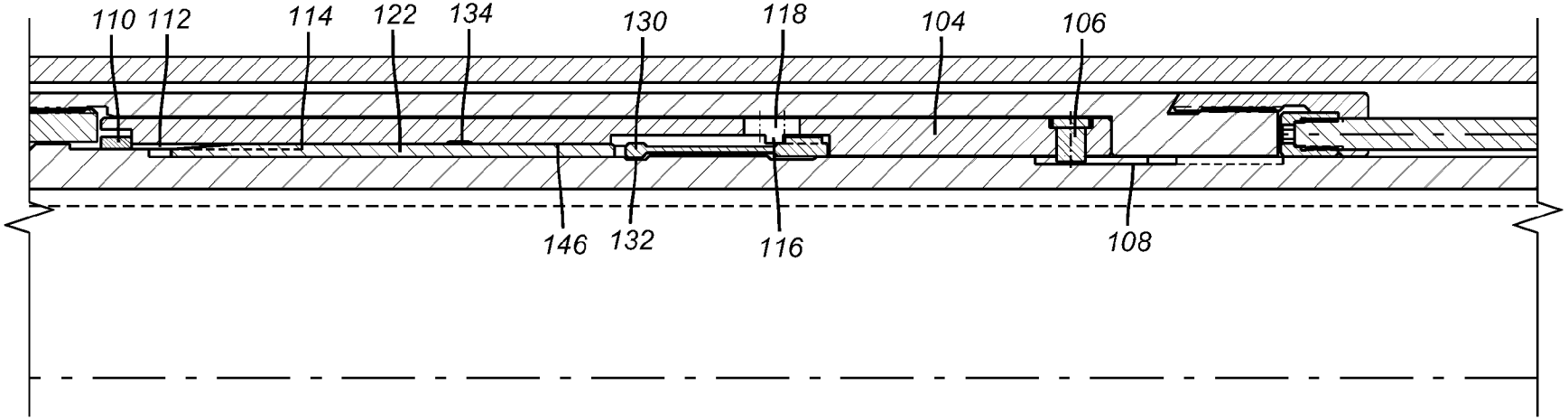
FIGS. 6*a*-6*b* show a portion of the module in FIGS. 2*a*-2*d* when pressured up just before opening.
Figure 6B:
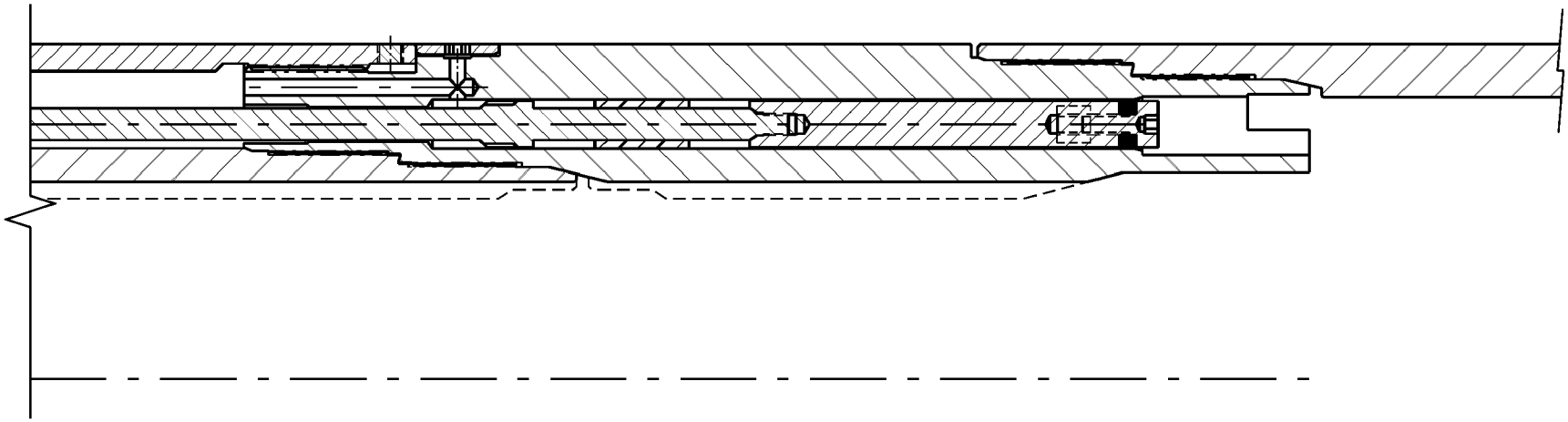

For all the cycles where there will be no actuation by extension of the rod 68 a sufficient distance to operate the tool that is mounted below it, FIGS. 2*c* and 2*d* represent the parts in the position where the pressure is bled from the tubing 78. FIGS. 6*a* and 6*b* generally represent the part configurations when pressure is applied to tubing 78. Comparing the two it can be seen that index sleeve 104 and its pin or pins 106 have moved up in j-slot 108 to position 142 in FIG. 3. The ramp sleeve 122 has moved up with index sleeve 104 but unlike index sleeve 104 the ramp sleeve 122 has not rotated while the index sleeve has rotated to get from position 144 to position 142 in the j-slot 108. The collet heads 130 are now in groove 132. Groove 134 has shifted up with the indexing sleeve 104. Note that in this pressure up cycle as in the previous pressure up cycles that did not lead to actuation when pressure was bled off, the collet heads 130 are not trapped in groove 132 but are free to break loose upon application of a downward force to the ramp sleeve 122. However, since FIG. 6 represents the final pressure up cycle before tool operation, it should be noted that the ridge 118 is no longer in registry with lug 124 but instead the opening 118 is now there. What this means is that when pressure is relieved after the FIG. 6 position is obtained, there will not be a downward force from ridge 118 on lug 124 as in all the previous pressure cycles. Note also that line 146 represents an upward travel stop to the indexing sleeve 104 that is shown schematically as it is located in a rotated section from the section being shown. Note also that snap ring 110 has moved up from the downward travel stop 114 in groove 112.

Figure 7A:
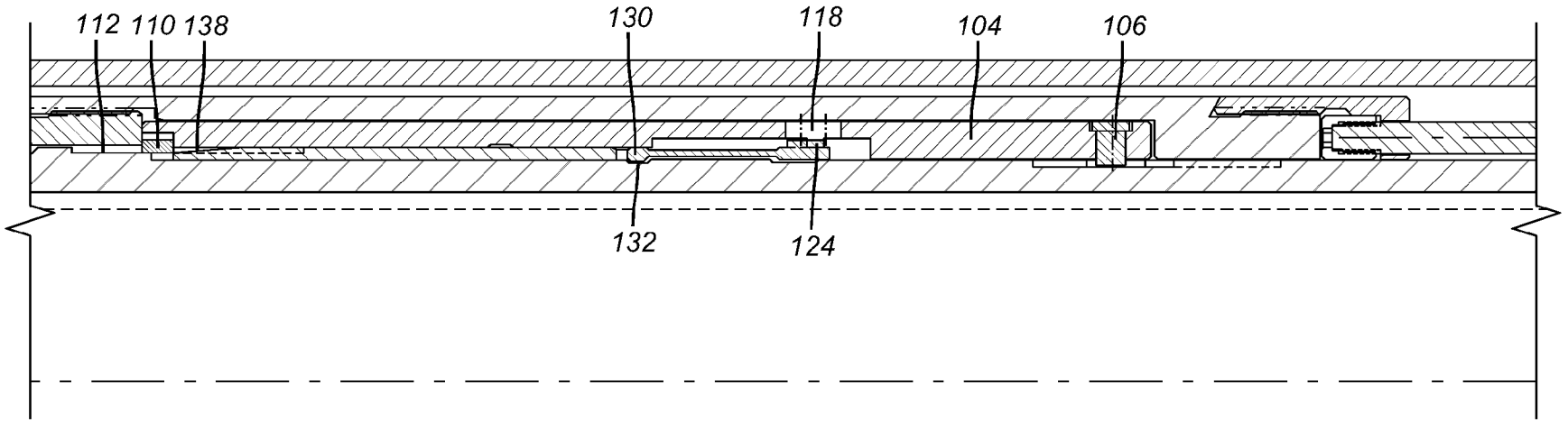
FIGS. 7*a*-7*b* show a portion of the module in FIGS. 2*a*-2*d* when pressure is starting to be released as the module is about to operate the tool.
Figure 7B:
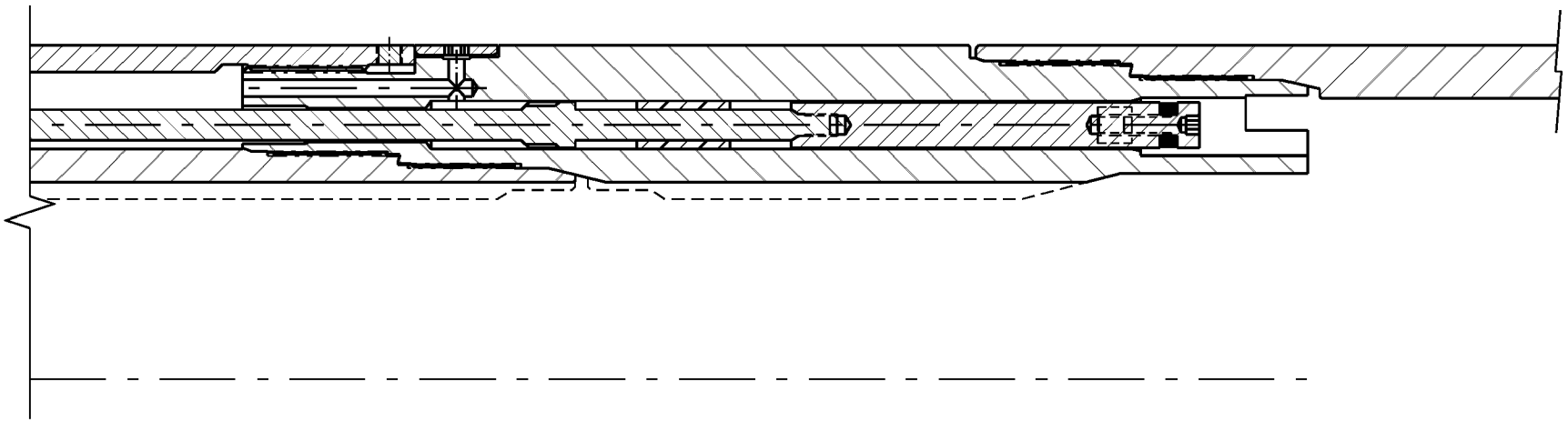

After the position of FIG. 6 is reached the pressure in the tubing 78 is bled off and FIG. 7 illustrates the next movement of the parts. As the applied pressure is bled off, the indexing sleeve 104 moves down without taking the ramp sleeve 122 with it because opening 118 rather than ridge 116 is juxtaposed at lug 124 of the ramp sleeve. Collet heads 130 are trapped by surface 148 of indexing sleeve 104 to groove 132. Snap ring 110 has moved closer to tapered ends 138 that have remained stationary with the rest of the ramp sleeve 122. The reason for all this is that with the collet heads 130 trapped, the ramp sleeve 122 cannot move as the indexing sleeve 104 keeps coming down such that the snap ring 110 will be forced up ramps 138 as the ramp sleeve is held anchored by collet heads 130. In effect the snap ring 110, which had before acted as the travel stop when pressure in the tubing 78 is removed, is no longer the travel stop as it has been forced out of its groove 112 after clearing the ramps 138. Pin 106 is in position 150 in the j-slot 108 as shown in FIG. 3.

Figure 8A:
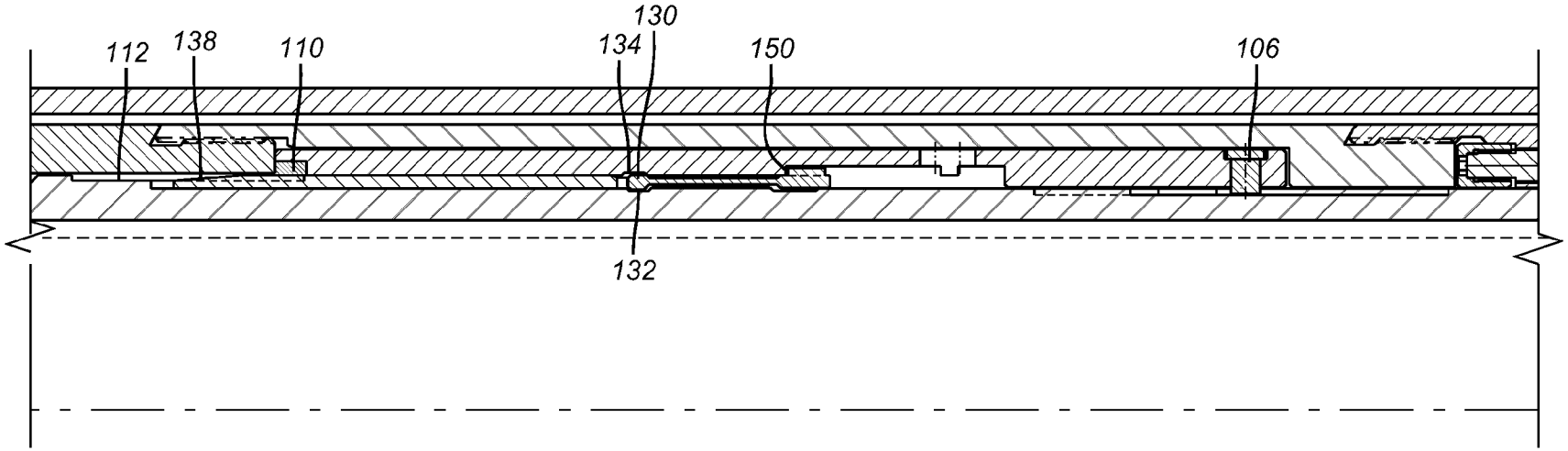
FIGS. 8*a*-8*b* show a portion of the module in FIGS. 2*a*-2*d* when the module begins to move an actuator to operate the tool.
Figure 8B:
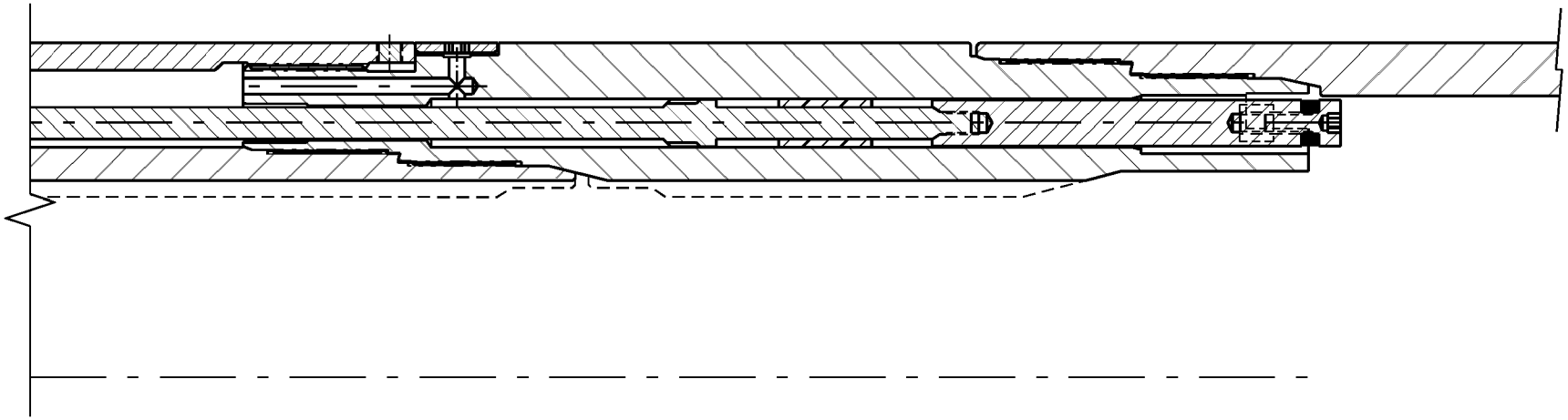

In FIG. 8 the snap ring 110 has ridden up ramps 138 and out of groove 112. Groove 134 on indexing sleeve 104 is now aligned with collet heads 130 such that those collet heads 130 are no longer locked to groove 132 to allow for tandem movement of the ramp sleeve 122 and the indexing sleeve 104 to move under the force of spring 100 with shoulder 150 on indexing mandrel 104 engaging the lug 124 on the ramp sleeve 122 for the downward tandem movement. Pin 106 is now in position 152 in the j-slot 108 shown in FIG. 3.

Figure 9A:
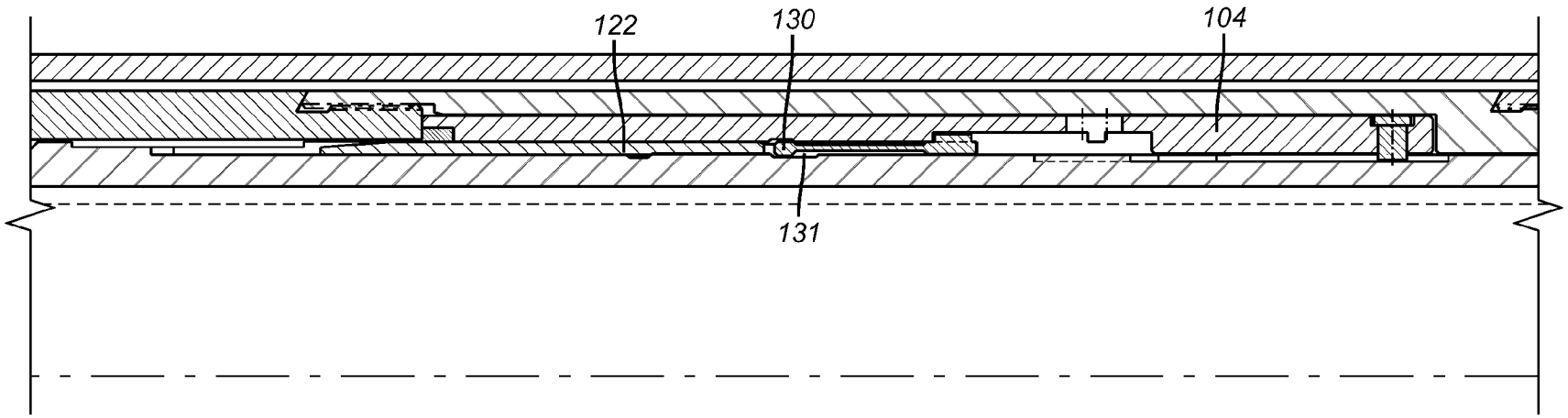
FIGS. 9*a*-9*b* show a portion of the module in FIGS. 2*a*-2*d* when the module has fully actuated.
Figure 9B:
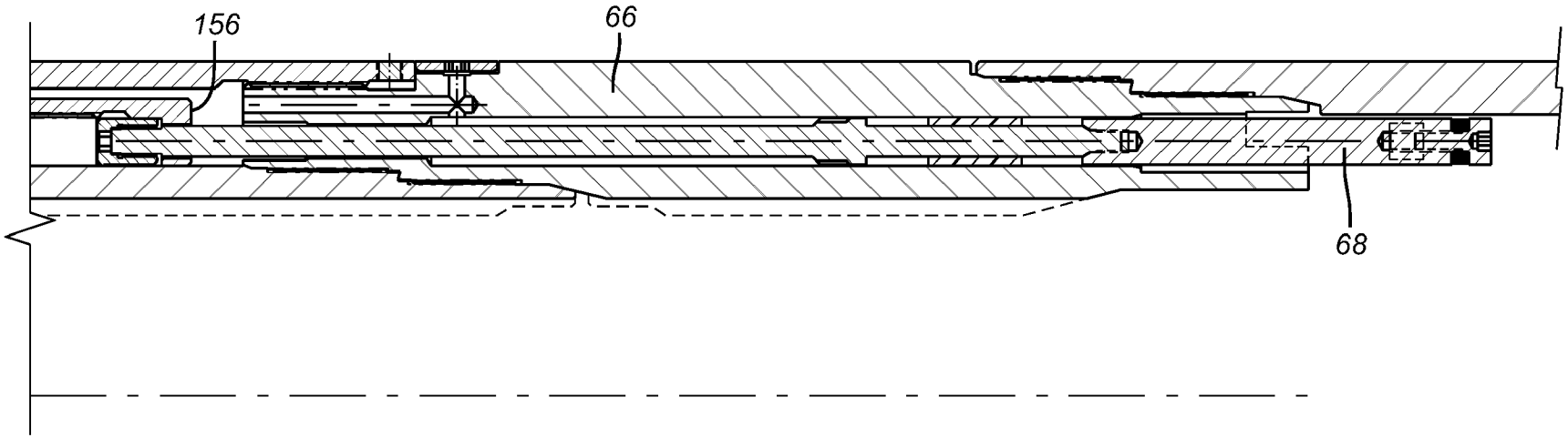

In FIG. 9 actuation of the downhole tool has occurred by extension of rod 68. The collet heads 130 have landed in groove 131. The ramp sleeve 122 has traveled a sufficient distance so that the ramps 138 clear the lower end 114 of the groove 112. The spring 100 has reached a relaxed state as the pin 106 has reached location 154 in the j-slot 108 shown in FIG. 3. Bottom sub 66 can serve as a travel limiter if needed as surface 156 approaches it.

Figure 3:
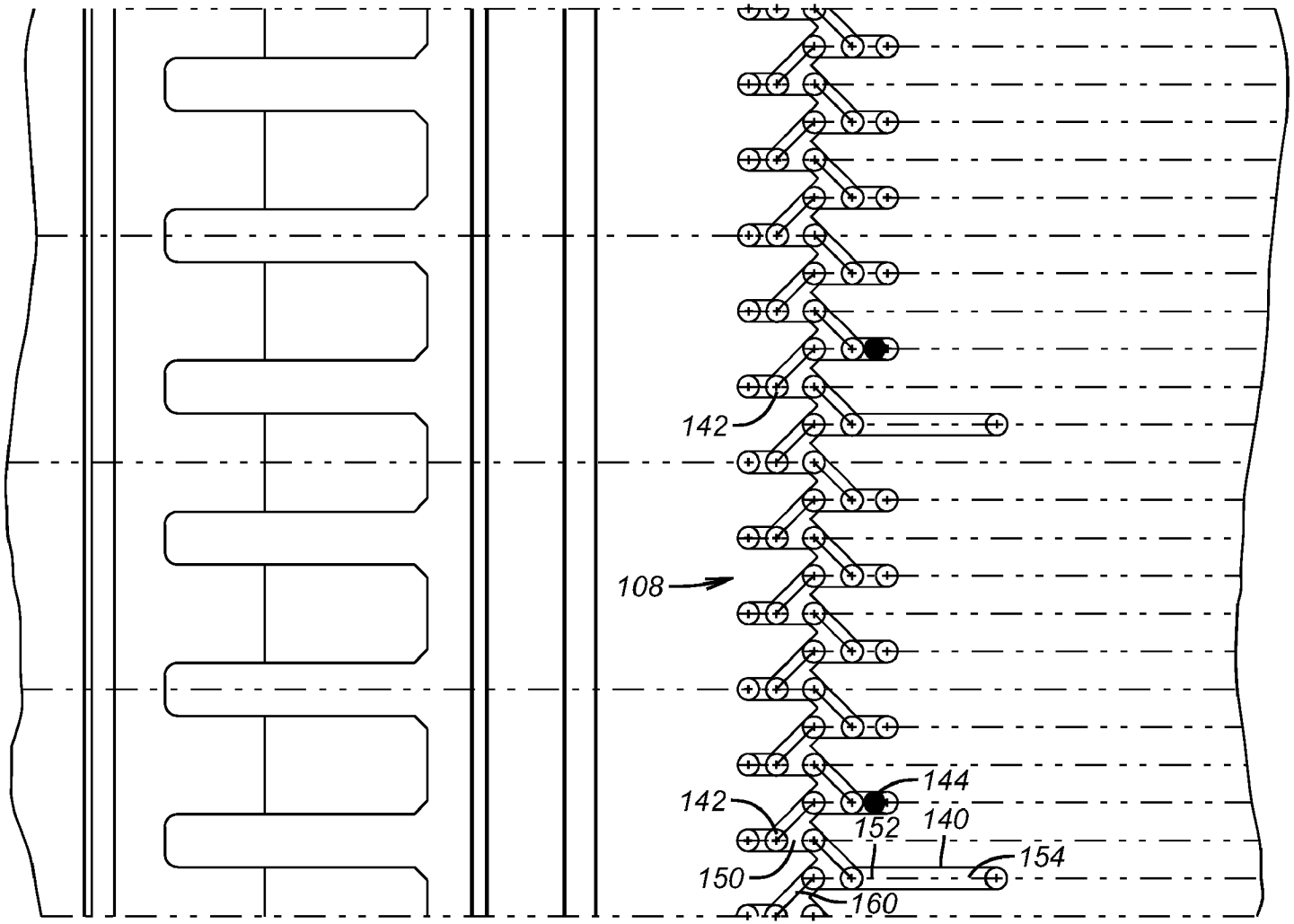
FIG. 3 is a rolled flat view of the mandrel showing the j-slot pin is in the FIG. 2 position.
Figure 10A:
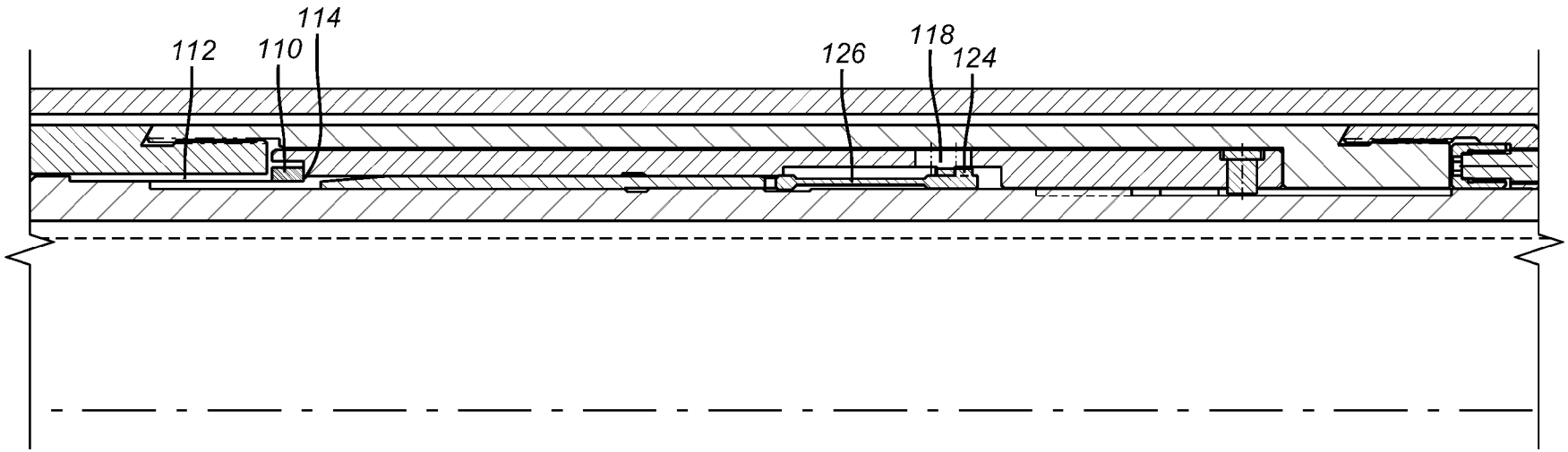
FIGS. 10*a*-10*b* show a portion of the module in FIGS. 2*a*-2*d* when the module has been reset.
Figure 10B:
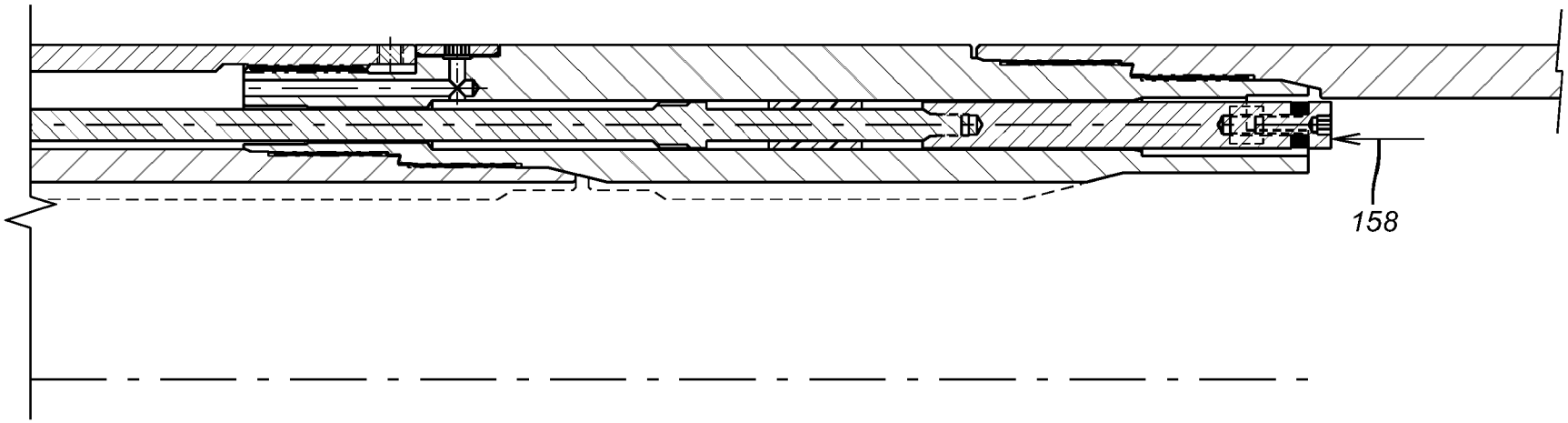

FIG. 10 represents with a schematic arrow 158 a mechanical tool inserted into the tubing 78 to physically displace the rod 68 back up to location 152 shown in the j-slot 108 shown in FIG. 3. The snap ring 110 is back in groove 112 and against its lower end 114 so that it again can resist the force of spring 100 as the pressure cycling procedure can be restarted for another occasion of needed actuation. Pin 106 has remained in the straight j-slot groove 140 during this procedure. Opening 118 is still juxtaposed to lug 124 on the ramp sleeve but at the next pressure up cycle the indexing sleeve 104 will rotate as it rises to present ridge 116 to lug 124 as a result of pin 106 going up path 160 shown in FIG. 3. Note the collet fingers 126 have not moved during the mechanical reset of FIG. 10 from the FIG. 9 position.

Those skilled in the art will appreciate that the FIG. 2 embodiment and its movements represent a modular assembly that can be coupled to any mechanically operated tool to add a pressure actuation feature. The further advantage of the FIG. 2 versus the FIG. 1 embodiment is that the module 60 can be pressure actuated multiple times with a mechanical reset in between actuations coming from a tool run into the module 60 such as a shifting tool, for example. With the design to allow multiple actuations described above those skilled in the art will appreciate that the rod 68 need only to be raised a short distance vertically enough to get the snap ring 110 back into groove 112 as the pin 106 tracks straight up in slot 140 of the j-slot 108 shown in FIG. 3.

Any number of pressure cycles can be designed into the tool before actuation limited only by the tool size that limits the ability to put more passages into the j-slot 108. While long slots 140 are shown 6 pressure cycles apart, those skilled in the art will realize that with the use of a blocking lug there will be no actuation until the all pins 106 line up with the long slot 140 with no blocking lug in the way. It is also clear to see that the embodiment of FIG. 1 is far simple while allowing but a single operation using pressure cycles. Spring 100 can be replaced with a charged chamber that is properly sealed.

Operators who need a downhole tool such as an isolation valve in an application where mechanical operation is sufficient no longer need to buy assemblies that offer features they don't want and for a higher cost. On the other hand where the project requirements change before the start and it is decided that a pressure actuation feature is in fact needed, the modular design of the present invention allows a simple add on module that can be secured to the tool to provide this feature. Adding the module allows the option of hydraulic operation for at least one direction of actuation and still leaves open the ability to operate the valve in opposed directions between open and closed purely mechanically even with the module attached.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claims, including the full range of equivalency to which each element thereof is entitled.

We claim:

1. A hydraulic actuation module and associated tool assembly for adapting a subterranean mechanically operated tool mounted on a tubular string to an alternative mode of operation, comprising:

a first tool having a tool passage therethrough and an actuator in said tool passage for selective mechanical actuation of the tool using a second tool run into said passage to engage said actuator to move said actuator to hold at least two positions of said first tool;

a modular housing having a module passage therethrough and a hydraulically actuated actuator member, said actuator member having a retracted position substantially within said modular housing until said modular housing is selectively connected to said first tool to substantially align said module passage with said tool passage and present said actuator member in operable non-overlapping contact with said actuator upon extension of said actuator member from said modular housing for a conversion of said first tool from mechanical to hydraulic operation.

2. The assembly of claim 1, wherein:

a potential energy source selectively constrained in said housing;

a pressure responsive lock to selectively apply potential energy from said source to move said actuator member and actuate said first tool;

said lock is responsive to pressure cycles of application and removal of pressure in said module passage.

3. The assembly of claim 2, wherein:

said actuator member comprises a piston having one end responsive to pressure in said module passage and another end exposed directly or indirectly to subterranean pressure outside said modular housing.

4. The assembly of claim 2, wherein:

said pressure responsive lock comprises a j-slot mechanism operably connected to said actuator member.

5. The assembly of claim 2, wherein:

said potential energy source comprises at least one spring or pressurized gas.

6. The assembly of claim 2, wherein:

said actuator member can be actuated more than once by said potential energy source.

7. A hydraulic actuation module and associated tool assembly for adapting a subterranean mechanically operated tool mounted on a tubular string to an alternative mode of operation, comprising:

a first tool having a tool passage therethrough and an actuator in said tool passage for selective mechanical actuation of the tool using a second tool to engage said actuator to move said actuator to hold at least two positions of said first tool;

a modular housing having a module passage therethrough and a hydraulically actuated actuator member, said modular housing when selectively connected to said first tool substantially aligns said module passage with said tool passage and presents said actuator member in operable contact with said actuator for a conversion of said first tool from mechanical to hydraulic operation;

a potential energy source selectively constrained in said housing;

a pressure responsive lock to selectively apply potential energy from said source to move said actuator member and actuate said first tool;

said lock is responsive to pressure cycles of application and removal of pressure in said module passage;

said actuator member can be actuated more than once by said potential energy source;

said actuator member, after an actuation, is displaced against said potential energy source with the second tool to reset said lock.

8. The assembly of claim 7, wherein:

said pressure responsive lock comprises a j-slot mechanism operably connected to said actuator member.

9. The assembly of claim 8, wherein:

said actuator member is extended by expending said potential energy source when at least one pin on said j-slot aligns with an actuation slot;

said potential energy source is re-energized by reversing movement of said actuator member while moving said pin only in said actuation slot.

10. The assembly of claim 9, further comprising:

a retainer selectively engaged to said modular housing to secure said potential energy source in response to movement of said pin only in said actuation slot.

11. The assembly of claim 9, wherein:

said actuation slot is longer than other slots in said j-slot mechanism.

12. A hydraulic actuation module assembly for adapting a subterranean mechanically operated tool mounted on a tubular string to an alternative mode of operation, comprising:

a housing having a passage therethrough and an actuator member;

a potential energy source selectively constrained in said housing;

a pressure responsive lock to selectively apply potential energy from said source to move said actuator and actuate the tool;

a connection on said housing to mount said housing to the tool for reconfiguring the mechanically operated tool to operate at least in part hydraulically using the module;

said actuator member can be actuated more than once by said potential energy source;

said actuator member, after an actuation, is displaced against said potential energy source to reset said lock;

said pressure responsive lock comprises a j-slot mechanism operably connected to said actuator member;

said actuator member is extended by expending said potential energy source when at least one pin on said j-slot aligns with an actuation slot;

said potential energy source is re-energized by reversing movement of said actuator member while moving said pin only in said actuation slot;

a retainer selectively engaged to said housing to secure said potential energy source in response to movement of said pin only in said actuation slot;

said retainer rides in a groove in said housing while said pin moves along other slots than said actuation slot.

13. The assembly of claim 12, wherein:

said retainer is forced against an end of said groove to act as a travel stop for said pin as it moves along other slots than said actuation slot in at least one direction.

14. The assembly of claim 12, wherein:

said retainer is forced out of said groove to allow said pin to travel in said actuation slot.

15. The assembly of claim 14, further comprising:

a ramp sleeve in said housing to selectively remove said retainer from said groove.

16. The assembly of claim 12, wherein:

said retainer is moved in opposed directions by an indexing sleeve that supports said pin when said indexing sleeve is actuated by pressure cycles in said passage acting on said actuator member;

said ramp sleeve moves in tandem with said indexing sleeve for pin movements along other slots than said actuation slot.

17. The assembly of claim 16, wherein:

said ramp sleeve is released from said indexing sleeve and temporarily secured to said housing as said retainer is removed from said groove by said ramp sleeve.

18. The assembly of claim 17, wherein:

said indexing sleeve comprises a ridge with a break;

said release of said ramp sleeve from said indexing sleeve coincides with alignment of said break with a lug on said ramp sleeve.

19. The assembly of claim 18, wherein:

said rotation of said indexing sleeve causes said alignment of said break with said lug coincidentally with said pin advancing toward said actuation slot to allow relative movement of said indexing sleeve relative to said ramp sleeve.

20. The assembly of claim 19, wherein:

said relative movement of said indexing sleeve to said ramp sleeve allows said indexing sleeve to releasably lock said ramp sleeve to said housing as said ramp sleeve forces said retainer from said groove.

21. The assembly of claim 20, wherein:

after said ramp sleeve removes said retainer from said groove, further relative movement of said indexing sleeve releases said ramp sleeve from said housing for subsequent tandem movement of said indexing sleeve and ramp sleeve powered by said potential energy source as said pin moves in said actuation slot to extend said actuating member and operate the tool.

* * * * *